United States Patent [19]

Holz et al.

[11] Patent Number: 4,564,241

[45] Date of Patent: Jan. 14, 1986

[54] POWER SUPPLY ARRANGEMENT FOR PULLED MINING MACHINES

[75] Inventors: Joachim Holz, Dortmund; Wolfgang Meier, Oer-Erkenschwick; Kurt Ogorek, Oberhausen; Heinrich Goris, Hamminkeln; Karl H. Schwarting, Voerde, all of Fed. Rep. of Germany

[73] Assignee: M.A.N. Maschinenfabrik Augsburg-Nürnberg Aktiengesellschaft, Fed. Rep. of Germany

[21] Appl. No.: 506,348

[22] Filed: Jun. 21, 1983

[30] Foreign Application Priority Data

Jul. 7, 1982 [DE] Fed. Rep. of Germany ..... 3224591

[51] Int. Cl.[4] ..... E21C 29/14; H02G 11/00

[52] U.S. Cl. ..... 299/43; 191/12 R

[58] Field of Search ..... 191/12 R; 299/43, 42, 299/47; 173/81; 198/735; 242/86.51; 254/400

[56] References Cited

U.S. PATENT DOCUMENTS

| | | | |
|---|---|---|---|
| 3,556,601 | 1/1971 | Domman et al. | 299/43 |
| 3,957,311 | 5/1976 | Rösler et al. | 299/43 |
| 4,063,782 | 12/1977 | Bähre et al. | 299/43 |
| 4,251,110 | 2/1981 | Beckmann et al. | 299/43 |
| 4,391,471 | 7/1983 | Hauschopp et al. | 299/43 |
| 4,458,950 | 7/1984 | Schwarting et al. | 299/43 |
| 4,474,411 | 10/1984 | Peters et al. | 299/43 |
| 4,483,567 | 11/1984 | Schwarting | 299/43 |

*Primary Examiner*—Randolph A. Reese
*Assistant Examiner*—David F. Hubbuch
*Attorney, Agent, or Firm*—McGlew and Tuttle

[57] ABSTRACT

A device for extending flexible power supply lines for mining machines which are guided on a conveyor structure and moved back and forth along a longwall by means of a traction element which includes a coal strand and a return strand extending with an enclosed space comprising a housing secured to the conveyor and enclosing a load strand. A return and a cable channel is alongside the load strand channel, with the flexible supply lines being stored at the ends of the longwall towed along by a mining machine through the cable channel. The housing is secured to the conveyor structure and open at one side, and an idle roller is mounted in the housing in the cable channel. The supply lines are supported on the idle rollers. The mining machine is moved by a traction element and the supply lines bear against the traction element at the open side of the cable channel.

15 Claims, 4 Drawing Figures

POWER SUPPLY ARRANGEMENT FOR PULLED MINING MACHINES

FIELD AND BACKGROUND OF THE INVENTION

This invention relates in general to mining machines and in particular to a new and useful device for extending flexible power supply lines to a mining machine on a conveyor structure.

In longwall operations, mining machines are moved back and forth the entire length of a longwall face and, as a rule, are guided on a conveyor structure. The mining machine is moved either by a traction chain or rope which is driven from the end of the longwall, or by a drive mechanism forming part of the mining machine. Various arrangements are known for supplying the mining machine with means for driving and operating, which will be termed "power" for short in the following.

For example, power supply lines may extend in a cable channel and be towed along by the mining machine, with the cable channel being mounted on a conveyor structure. With such an arrangement, it is usual to lay the lines individually, or bundled in a cable chain. It is further known to train the power lines as loops by means of a cable trolley which is guided in a side bracket channel of the conveyor and equipped with guide rollers for the lines. The cable trolley is moved by the mining machine or, in accordance with the travel thereof, by winches from the working face ends.

With low traveling speeds of the mining machine, the first named method may still be satisfactory for a regular laying of the towed lines. With higher speeds, however, this becomes problematic. The relatively high friction resistance encountered by the towed lines on the stationary surface strongly shortens the life of the lines. Frequent bending beyond the minimum radius, primarily in low seams, increases the risk of fatigue failures in the lines. The use of cable chains produces considerable additional noise in operation. Further, dislodged material, accumulating in the cable channel which is open at its top, hinders the cable guidance. In addition to the drawbacks connected to the cable chain guidance, a guidance in loops entails jerky loads leading to strong local whips toward the sides and/or vertically of the line portions. This requires sufficiently high brackets for the cable channel, preventing the structure from being used in lower workings.

Further known is a power supply arrangement providing that the mining machine pulled back and forth along the face is guided on a conveyor structure, and the supply lines are gathered and stored at the longwall ends and continuously laid down onto the element pulling the machine, within a housing which is secured to the conveyor structure. The element pulling the machine carries supporting strips for receiving the supply lines placed thereon. The supporting strips may be forked. The channel for receiving the power supply lines which extend stretched along the face is open upwardly and may become filled with the extracted material. This material, the bulk of which is taken along by the flights of the conveyor chain, appreciably increases the frictional resistance. Fragments from the roof may fall down into the open channel and damage the lines or the supporting strips. Also, in this arrangement, the power line and the traction element are strained unequally, so that the supporting strips and the lines are in perpetual motion relative to each other, which augments the wear and additionally stresses the lines. The introduction of the flexible supply lines at the end of the longwall becomes expensive and problematic, particularly in view of the "hanging chain" which is expected and its soiling.

SUMMARY OF THE INVENTION

The invention is directed to a power supply arrangement permitting stretched lines to be used in seams of small thickness, and comprising constructions which are rugged and simple and therefore require little maintenance.

To this end and in accordance with the invention, it is provided to support the supply lines on idle rollers which are mounted within a cable channel. The cable channel is associated with the respective loaded strand of the traction element of the mining machine. The power supply lines are trained to a traveling mining machine over a roller bed formed by idle rollers. The rollers are mounted at uniformly spaced locations within the cable channel, with the rollers turning about a vertical axis and those limiting the channel upwardly being preferably provided only at the joints of the cable channel sections, and the rollers limiting the channel downwardly being mounted in each channel section at lesser spaced locations.

In accordance with the invention, if mining machines moved by a traction element are employed, the supply lines bear against the traction element at the open side of the cable channel. The open side of the cable channel is therefore designed as a continuous slot and aligned with a corresponding slot provided in the channel of the traction element.

The traction element may be provided at equidistantly spaced locations with clamps. The purpose of the clamp is to prevent the traction element from slipping out of its channel. The clamps are in two parts and screwed, for example, each to a horizontal chain link. Advantageously, such clamps have a maximum diameter corresponding to a circle circumscribed to the chain.

Within the cable channel, the line for supplying electric power is advantageously run adjacent the open side facing the channel for the traction element, if a simultaneous supply of water is provided.

At the longwall ends, the cable channel is flared to a funnel shape, with the power supply lines being introduced therein in the axial direction. It is advisable to run the lines between a cable drum placed in the entry, and the cable channel in the workings, also within an all-round closed channel.

In accordance with the invention, the cable channel is closed with a detachably secured cover.

The channel for the traction element and the cable channel form together with the conveyor structure a constructional unit, to be assembled of building block elements.

The cable channel and the channel for the traction element are designed with holes in their bottoms, through which material having penetrated therein can be removed during the advance operation. These holes communicate with each other through recesses at the waste side. With the cable channel provided at the waste side, the supply lines are introduced to the mining machine through a shoe portion or a gantry structure of the machine.

Accordingly, it is an object of the invention to provide a new and useful device which is adapted to be secured to the conveyor of a mining machine and which includes a housing having a channel portion for a loaded strand and a return strand of a conveyor and a cable channel which has idle rollers which support the power supply lines and which are advantageously located alongside the loaded strand channel.

A further object of the invention is to provide a device for supporting flexible power supply lines for use in association with a mining machine in a housing which is secured to the conveyor of a machine and which accommodates both a loaded and a return strand and which includes a cable channel having guide rollers over which the power strands are positioned.

A further object of the invention is to provide a device for facilitating the supply of power to mining machines which is simple in design, rugged in construction and economical to manufacture.

The various features of novelty which characterize the invention are pointed out with particularity in the claims annexed to and forming a part of this disclosure. For a better understanding of the invntion, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
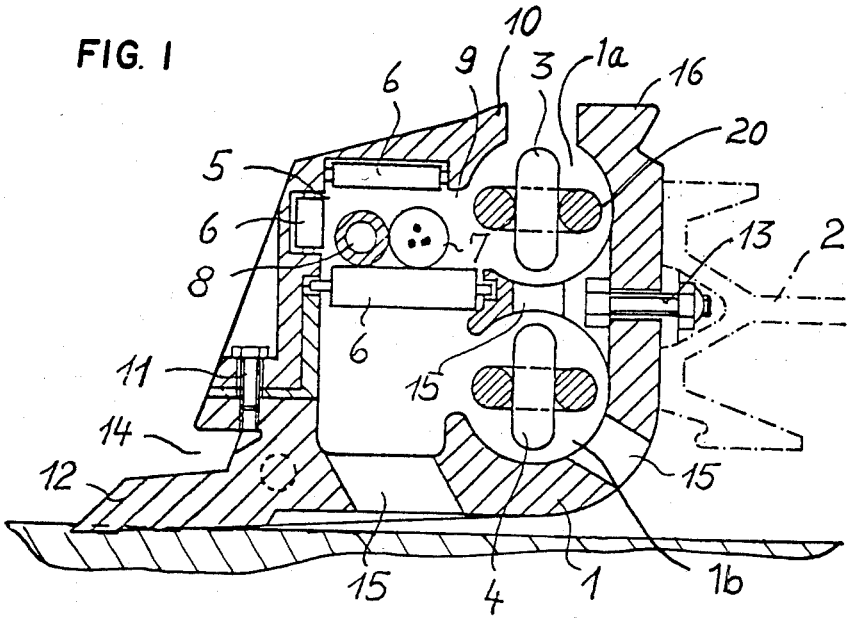
FIG. 1 is a sectional view of the conveyor structure with a cable channel and a traction chain channel provided at the side of the longwall face.

Referring to the drawings in particular, the invention embodied therein in FIG. 1 comprises a device for extending flexible power supply lines for mining machines which are guided on a conveyor structure which is moved backwardly and forwardly along a longwall by means of a traction element including a load strand and a return strand which extends within an enclosed space, comprising a housing secured to the conveyor and enclosing a load strand channel and a return strand channel and a cable channel alongside said load strand channel, said cable channel having an idler roller mounted therein in said cable channel for accommodating the flexible supply lines, said housing being secured to the conveyor structure and being opened at one side.

Structural elements for guiding the traction rope or chain 20 and the supply lines 7,8 for the mining machine in a longwall operation may be screwed to the conveyor, or made integral therewith; and they may be provided at the side of working face, or at the waste side, adjacent each other, or one above the other.

With the channels provided above one another at the side of the working face, as shown in FIG. 1, channels 1*a* and 1*b* for the loaded strand 3 and the return strand 4 of the traction chain and the cable channel 5 are provided in a common housing 1 which is screwed or otherwise secured to the conveyor 2. In such an arrangement, the upper channel 1*a* of the traction chain guides the loaded strand 3, and the lower channel guides the return strand 4.

With channels for the two traction chain strands provided side by side (not shown), there is no preference for the mutual position of the strands. This applies for arrangements both at the face and at the waste side of the conveyor.

In accordance with the shown embodiments, the cable channel 5 in which supply lines 7 and 8 leading to the mining machine (not shown) traveling in front of the longwall are guided, is associated with the channel 1*a* for the loaded strand 3 of the traction chain.

Idle rollers 6 are mounted on three sides of cable channel 5. Upwards and to the side, it is satisfactory to provide rollers 6 in a single channel length or section only at the joints of the section, while downwardly, it is advisable to provide more than two rollers in each section, to ensure an exact support of supply lines 7 and 8.

Supply lines 7 and 8 are placed on the lower bed of rollers 6 in juxtaposition. At locations where the conveyor follows a curved configuration of the workings, the lines may come to bear against the upper rollers or side rollers. Toward the loaded strand 3 of the traction chain, cable channel 5 is open and the provided slot 9 between channel 5 and channel 1*a* is continuous. In this area, the supply line extending in the cable channel, preferably the power cable 7, can bear against the loaded strand 3 of the traction chain. The flexible line 8 for low-pressure water extends adjacent power line 7, at the closed side of cable channel 5.

At the top, cable channel 5 is closed with a detachable cover 10 which also partly extends over loaded strand 3 of the traction chain. Cover 10 is secured to the base 12 of housing 1 by screws 11.

Housing 1 is secured to conveyor 2 by bolts 13.

The channels for traction chain 3 and 4 and for supply lines 7 and 8 are designed with thruholes 15 in their bottoms, to enable material which may have penetrated into the channels to pass to the floor. Holes 15 of cable channel 5 and of the chain channel communicate with each other through recesses provided at the floor.

Figure 2:
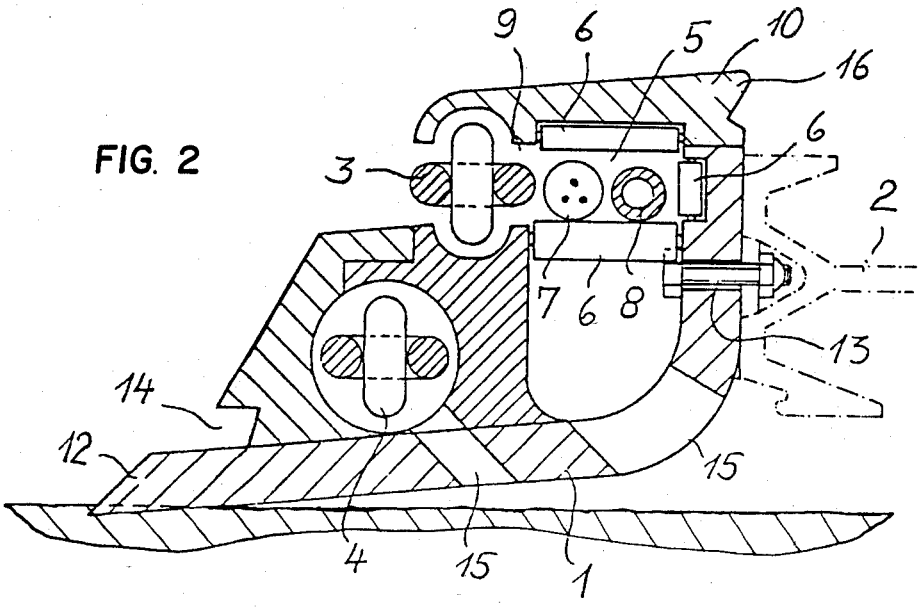
FIG. 2 is a view corresponding to FIG. 1, with the cable channel extending adjacent the conveyor structure.

In the embodiment of FIG. 2, cable channel 5 is provided adjacent conveyor 2. Housing 1 is designed with projections 16 and recesses 14 serving the purpose of guiding the mining machine.

Figure 3:
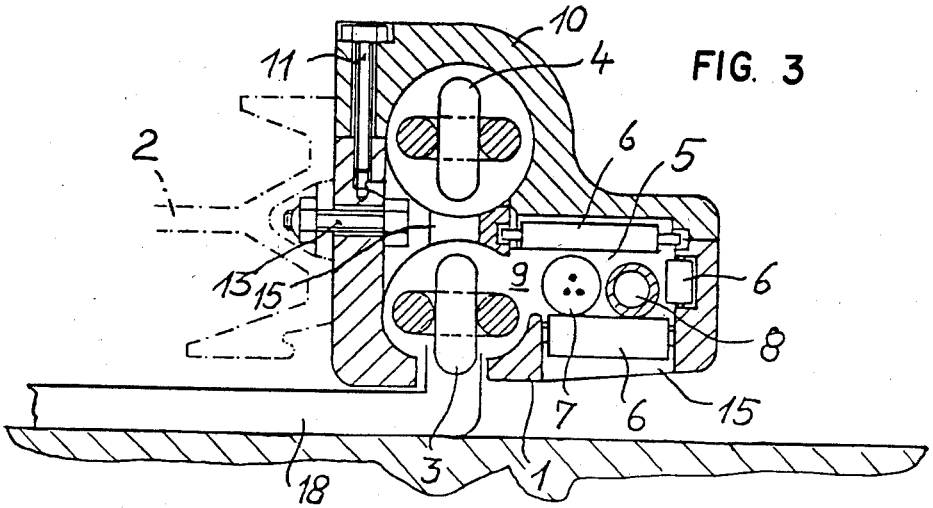
FIG. 3 is a view similar to FIG. 1, with two channels provided at the waste side and a shoe portion extending below the conveyor.
Figure 4:
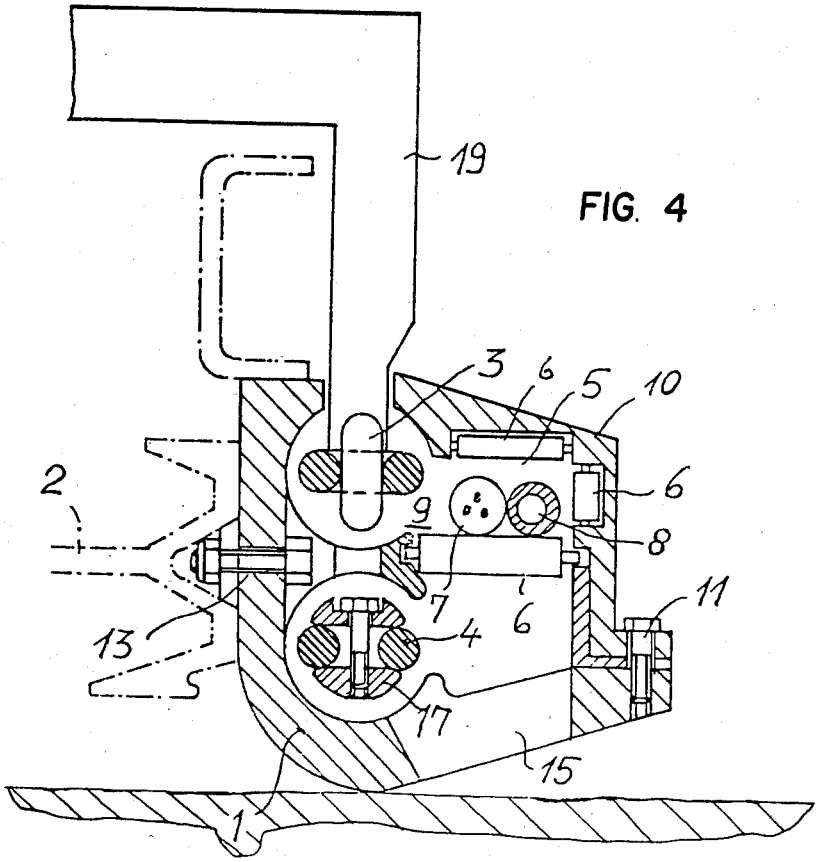
FIG. 4 is a view corresponding to FIG. 3, with a gantry portion bridging the conveyor.

According to FIGS. 3 and 4, traction chain 3 and 4 and cable channel 5 extend at the waste side of the conveyor. In the embodiment of FIG. 3, supply lines 7, 8 are introduced to the mining machine through a shoe 18.

In FIG. 4, a gantry structure 19 is indicated through which supply lines 7, 8 extend to the mining machine. FIG. 4 further shows a clamp 17 fixed to the traction chain. Clamps 17 are fastened to the chain by screws at spaced apart locations to prevent the chain from slipping out of the channel.

The clamps 17 are made of two parts which extend in the longitudinal direction and are bolted together as shown in FIG. 4. The clamps 17 also have diameters that match the circle circumscribed by the chain 3. This is also shown in FIG. 4.

While specific embodiments of the invention have been shown and described in detial to illustrate the application of the principles of the invention, it will be understood that the invention may be embodied otherwise without departing from such principles.

What is claimed is:

1. A device for extending flexible supply lines for mining machines which are guided on a conveyor structure moved back and forth along a longwall and over a mine floor by means of a traction element including a load strand and a return strand extending within an enclosed space, comprising a housing secured to the conveyor and enclosing a load strand channel, a return strand channel, and a cable channel alongside and communicating with said load strand channel, with the flexible supply line being stored at the ends of the longwall and towed along by a mining machine through said cable channel, said cable channel having four sides, one of which is open in a continuous slot to said load strand channel, said housing being secured to the conveyor and open at one side, and a plurality of idle rollers mounted in said housing in said cable channel, said supply lines being supported on some of said idle rollers, said idle rollers extending over three remaining sides of said cable channel and said cable channel being upwardly closed.

2. A device according to claim 1, including clamps connected to said load strand and said return strand in uniformly spaced locations.

3. A device according to claim 2, wherein said clamps are formed of two parts extending in longitudinal directions and bolted together to a horizontal chain link.

4. A device according to claim 1, wherein said load strand and said return strand comprise a continuous chain conveyor, a clamp made of two parts connected to said chain conveyor at locations along its length and having diameters corresponding to the circle circumscribed by said chain.

5. A device according to claim 1, wherein said supply lines include a water supply line and an electric power line.

6. A device according to claim 1, including a detachable cover closing the top of said cable channel.

7. A device according to claim 1, including an opening defined between the load strand and the return strand and including an opening to the mine floor from said strand channels.

8. A device according to claim 7, wherein the openings in said channels communicate with each other through recesses which are open to a waste side of the longwall.

9. A device according to claim 1, wherein said housing has a shoe extending therein through which the supply lines are supplied to the housing.

10. A device according to claim 1, including a gantry structure overlying said housing and having a portion extending into said housing above said loaded strand channel.

11. A device according to claim 10, including a wall of said housing adjacent said load strand channel and said return strand channel which is secured to the conveyor.

12. A device according to claim 10, including a wall of said housing adjacent to said cable channel and secured to said conveyor, said load strand channel opening laterally away from said conveyor.

13. A device according to claim 10, wherein said load strand channel is below said return strand channel, said housing having said cable channel being located alongside said load strand channel, said housing having a wall on the side thereof opposite to said cable channel which is connected to the conveyor.

14. A device according to claim 13, wherein said housing includes a plurality of through holes communicating said load strand channel with said current strand channel, said load strand channel having a lower opening for passage of material out of said load strand channel onto the mine floor.

15. A device according to claim 1, wherein said load strand channel overlies said return strand channel, said cable channel being in communication with said load strand channel and including at least one horizontally disposed roller over which the supply lines are engaged and which is located alongside said strand channels.

* * * * *